US011700881B2

(12) United States Patent
Liu et al.

(10) Patent No.: US 11,700,881 B2
(45) Date of Patent: Jul. 18, 2023

(54) ULTRASONIC LIQUID ELECTRONIC CIGARETTE ATOMIZER AND ULTRASONIC LIQUID ELECTRONIC CIGARETTE

(71) Applicant: CHINA TOBACCO HUNAN INDUSTRIAL CO., LTD., Hunan (CN)

(72) Inventors: Jianfu Liu, Hunan (CN); Kejun Zhong, Hunan (CN); Xiaoyi Guo, Hunan (CN); Wei Huang, Hunan (CN); Hong Yu, Hunan (CN); Yuangang Dai, Hunan (CN); Xinqiang Yin, Hunan (CN); Jianhua Yi, Hunan (CN); Yongquan Zhou, Hunan (CN)

(73) Assignee: CHINA TOBACCO HUNAN INDUSTRIAL CO., LTD., Hunan (CN)

( * ) Notice: Subject to any disclaimer, the term of this patent is extended or adjusted under 35 U.S.C. 154(b) by 514 days.

(21) Appl. No.: 16/759,679

(22) PCT Filed: Oct. 30, 2018

(86) PCT No.: PCT/CN2018/112574
§ 371 (c)(1),
(2) Date: Apr. 27, 2020

(87) PCT Pub. No.: WO2019/085874
PCT Pub. Date: May 9, 2019

(65) Prior Publication Data

US 2020/0305500 A1 Oct. 1, 2020

(30) Foreign Application Priority Data

Oct. 30, 2017 (CN) ..... 201721420209.9

(51) Int. Cl.
*A24F 40/05* (2020.01)
*A24F 40/42* (2020.01)
(Continued)

(52) U.S. Cl.
CPC ..... *A24F 40/05* (2020.01); *A24F 40/42* (2020.01); *A24F 40/48* (2020.01); *A24F 40/485* (2020.01); *A24F 40/10* (2020.01)

(58) Field of Classification Search
CPC ..... A24F 40/05; A24F 40/42; A24F 40/48
See application file for complete search history.

(56) References Cited

U.S. PATENT DOCUMENTS 9,986,762 B2 * 6/2018 Alarcon ..... A24F 40/42
2016/0073692 A1 * 3/2016 Alarcon ..... A24F 40/44 131/329
2016/0100633 A1 * 4/2016 Gao ..... H05B 1/0244 131/329

FOREIGN PATENT DOCUMENTS

CN 103300480 A * 9/2013 ..... A24F 47/008
CN 204949520 U * 1/2016 ..... A24F 47/008
(Continued)

OTHER PUBLICATIONS

International Search Report issued in international Application No. PCT/CN2018/112574 dated Jan. 22, 2019, 2 pages.

*Primary Examiner* — Hae Moon Hyeon
(74) *Attorney, Agent, or Firm* — Mauriel Kapouytian Woods LLP; Ran Pang; Michael Mauriel

(57) ABSTRACT

An ultrasonic liquid electronic cigarette atomizer and an ultrasonic liquid electronic cigarette are disclosed. The ultrasonic liquid electronic cigarette atomizer comprises an atomization core, a suction nozzle and an air outlet tube. A bottom end of the air outlet tube is communicated with an atomization chamber of the atomization core. A top end of the air outlet tube is communicated with the suction nozzle.
(Continued)

The top end of the air outlet tube is communicated with a bottom end of the suction nozzle through a liquid blocking chamber, and the diameter of a top end of the liquid blocking chamber is greater than the diameter of the bottom end of the suction nozzle. The atomizer further comprises a connecting seat between the liquid blocking chamber and the suction nozzle.

18 Claims, 3 Drawing Sheets

(51) Int. Cl.

| | |
|---|---|
| ***A24F 40/48*** | (2020.01) |
| ***A24F 40/485*** | (2020.01) |
| *A24F 40/10* | (2020.01) |

(56) References Cited

FOREIGN PATENT DOCUMENTS

| | | | |
|---|---|---|---|
| CN | 206341940 | U | 7/2017 |
| CN | 207383537 | U | 5/2018 |
| WO | 2016115701 | A1 | 7/2016 |

* cited by examiner

ULTRASONIC LIQUID ELECTRONIC CIGARETTE ATOMIZER AND ULTRASONIC LIQUID ELECTRONIC CIGARETTE

CROSS REFERENCE TO RELATED APPLICATIONS

This application is a U.S. National Phase application under 35 U.S.C. § 371 of International Application No. PCT/CN2018/112574 filed on Oct. 30, 2018, which claims priority to Chinese Application Number 201721420209.9 filed on Oct. 30, 2017. The entire contents of these applications are hereby incorporated herein by reference.

FIELD OF THE INVENTION

The present invention belongs to the technical field of electronic cigarettes, and particularly relates to an ultrasonic liquid electronic cigarette atomizer and an ultrasonic liquid electronic cigarette.

BACKGROUND OF THE INVENTION

An ultrasonic liquid electronic cigarette atomizer includes an atomization core, a suction nozzle, an air inlet hole, an air inlet tube, an air outlet tube and a liquid chamber, wherein the air inlet hole is communicated with an atomization chamber of the atomization core through the air inlet tube, the atomization chamber of the atomization core is communicated with the suction nozzle through the air outlet tube, and the liquid chamber is used to supply e-liquid to an ultrasonic atomization sheet in the atomization core.

In the existing ultrasonic liquid electronic cigarette atomizer, the air outlet tube is directly connected to the suction nozzle. During smoking, the electronic cigarette is tilted, the end of the suction nozzle is downward, liquid droplets are condensed on the inner wall of the air outlet tube, and the liquid droplets will move toward the suction nozzle with the air flow of smoking under gravity, so the user is likely to suck the liquid droplets, and the smoke taste is poor. At the same time, the air inlet of the existing electronic cigarette is a small hole near the suction nozzle, so the air inlet channel is easily blocked by the hand or mouth, and the user experience is poor.

SUMMARY OF THE INVENTION

The present invention is directed to provide an improved ultrasonic liquid electronic cigarette atomizer and an ultrasonic liquid electronic cigarette with respect to the shortcomings of the prior art, where a user hardly sucks liquid droplets, the smoke taste is good, at the same time, an air inlet channel can be prevented from being blocked by the hand or mouth, and the user experience is good.

In order to solve the technical problem that the user easily sucks liquid droplets, the technical solution adopted by the present invention is as follows:

An ultrasonic liquid electronic cigarette atomizer is provided, including an atomization core, a suction nozzle and an air outlet tube, a bottom end of the air outlet tube being communicated with an atomization chamber of the atomization core, a top end of the air outlet tube being communicated with the suction nozzle, wherein the top end of the air outlet tube is communicated with a bottom end of the suction nozzle through a liquid blocking chamber, and the diameter of a top end of the liquid blocking chamber is greater than the diameter of the bottom end of the suction nozzle.

With the above structure, the top end of the air outlet tube is communicated with the bottom of the suction nozzle through the liquid blocking chamber, so that when a person smokes by tilting an electronic cigarette, the smoke first passes through the air outlet tube, the liquid blocking chamber and then reaches the suction nozzle. Because the diameter of the top end of the liquid blocking chamber is greater than the diameter of the bottom end of the suction nozzle, liquid droplets in the smoke accumulate in the liquid blocking chamber without flowing out along an inner side wall of the suction nozzle, which can prevent a user from sucking the liquid droplets and achieve a good smoke taste.

Further, the ultrasonic liquid electronic cigarette atomizer includes a connecting seat between the liquid blocking chamber and the suction nozzle, wherein an air tube is disposed in the connecting seat, the bottom of the air tube extends into the liquid blocking chamber, the side wall of the air tube is not in contact with the side wall of the liquid blocking chamber, and the liquid blocking chamber is communicated with the suction nozzle through the air tube.

With the above structure, the liquid blocking chamber is communicated with the suction nozzle through the air tube, and the air tube extends into the liquid blocking chamber and is not in contact with the inner wall of the liquid blocking chamber, thereby further blocking the liquid droplets in the liquid blocking chamber from entering the user's mouth through the suction nozzle, and improving the smoke taste and user experience.

Further, in order to solve the technical problem that the air inlet channel is easily blocked by the hand or mouth, the technical solution adopted by the present invention is that the ultrasonic liquid electronic cigarette atomizer further includes an air inlet tube, wherein one end of the air inlet tube is communicated with the atomization chamber of the atomization core, and the other end of the air inlet tube is communicated with the outside through an annular air inlet channel formed along the circumference of the side wall of the atomizer.

Since the air inlet channel is formed along the circumference of the side wall of the atomizer, the air inlet channel can be prevented from being blocked by the hand or mouth to affect the smoking effect.

As a preferred mode, a liquid chamber cover is disposed between the connecting seat and the air outlet tube, and the liquid blocking chamber is disposed at the top of the liquid chamber cover.

As a preferred mode, an annular air inlet channel surrounding the side wall of the atomizer is formed between the bottom of the suction nozzle and the connecting seat, and the air inlet channel is communicated with the atomization chamber of the atomization core through the air inlet tube.

As a preferred mode, the connecting seat is detachably connected to the liquid chamber cover.

The connecting seat is detachably connected to the liquid chamber cover, and when the atomizer is used multiple times or used for a long time, the connecting seat can be detached, and then the liquid blocking chamber is cleaned, so that the atomizer is more hygienic and liquid droplets can be further prevented from being sucked.

As a preferred mode, the atomization core is detachably connected to the bottom of the air outlet tube.

The atomization core is detachably connected to the air outlet tube, so that the atomization core is more convenient to replace, and the use cost is reduced.

Further, an air chamber is formed at the bottom of the suction nozzle, the connecting seat is provided with an air inlet, and the air inlet channel, the air chamber, the air inlet, the air inlet tube, and the atomization chamber of the atomization core are communicated in sequence.

During smoking, air enters the air chamber from the annular air inlet channel, and then enters the air inlet tube through the air inlet in the connecting seat.

Further, the ultrasonic liquid electronic cigarette atomizer includes a liquid chamber, wherein the atomization core includes an ultrasonic atomization sheet and a liquid guiding structure, and the ultrasonic atomization sheet is communicated with the liquid chamber through the liquid guiding structure.

Based on the same inventive concept, the present invention also provides an ultrasonic liquid electronic cigarette, including the ultrasonic liquid electronic cigarette atomizer. Compared with the prior art, the present invention has the advantages that the user hardly sucks liquid droplets, the smoke taste is good, at the same time, the air inlet channel can be prevented from being blocked by the hand or mouth, and the user experience is good.

In which: 1 atomization core, 2 suction nozzle, 3 air outlet tube, 4 liquid blocking chamber, 5 connecting seat, 6 air tube, 7 air inlet tube, 8 air inlet channel, 9 liquid chamber cover, 10 air chamber, 11 air inlet, 12 liquid chamber, 13 ultrasonic atomization sheet, 14 liquid storage sleeve, 15 inner sleeve, 16 outer sleeve, 17 atomization cotton, 18 liquid storage cotton, 19 liquid inlet hole, 20 atomization seat, 21 electrode, 22 cotton compression spring, 23 gasket, 24 base.

DETAILED DESCRIPTION OF EMBODIMENTS

Figure 1:
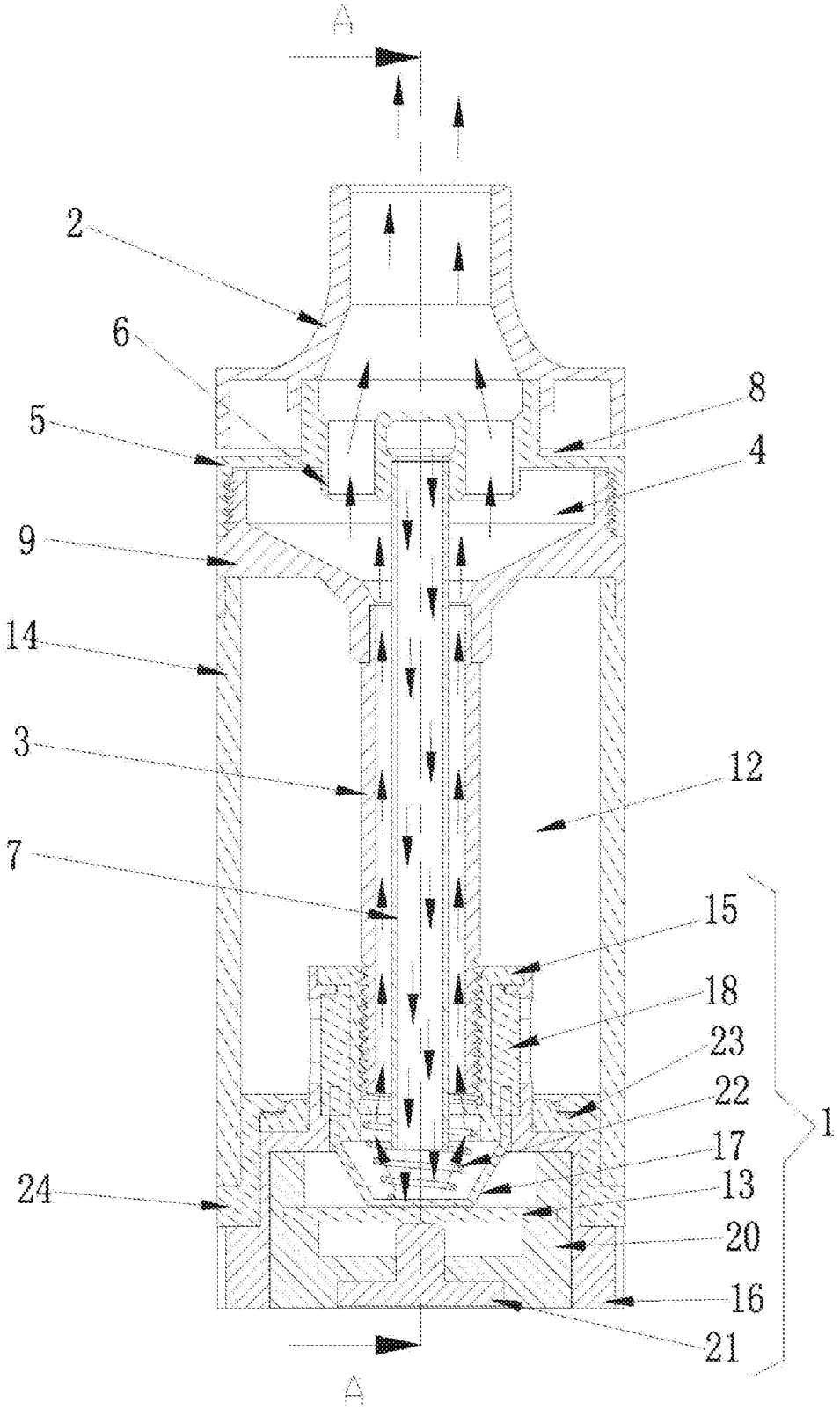
FIG. 1 is a front cross-sectional view of an embodiment of the present invention.
Figure 2:
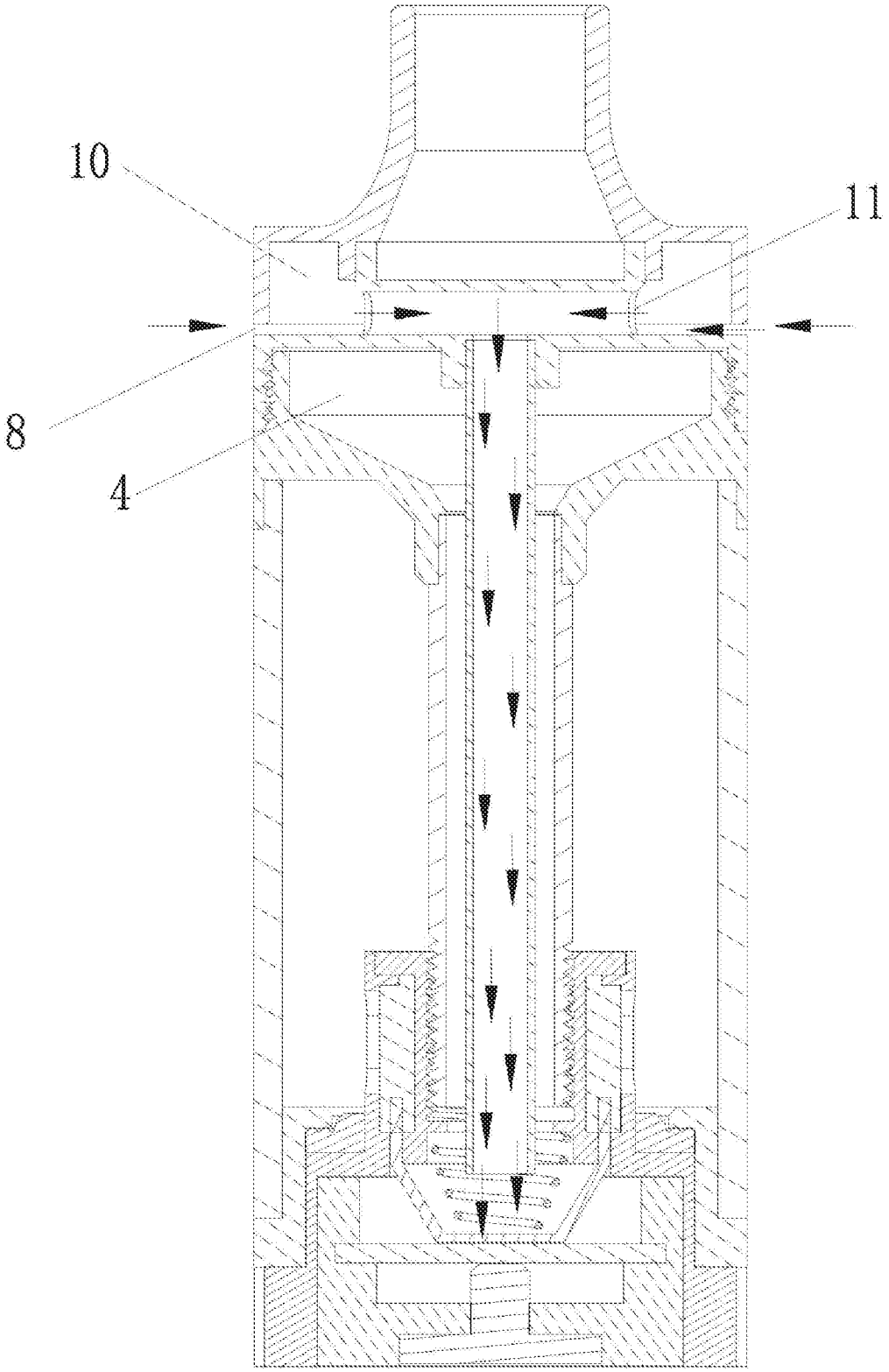
FIG. 2 is a cross-sectional view of A-A in FIG. 1.
Figure 3:
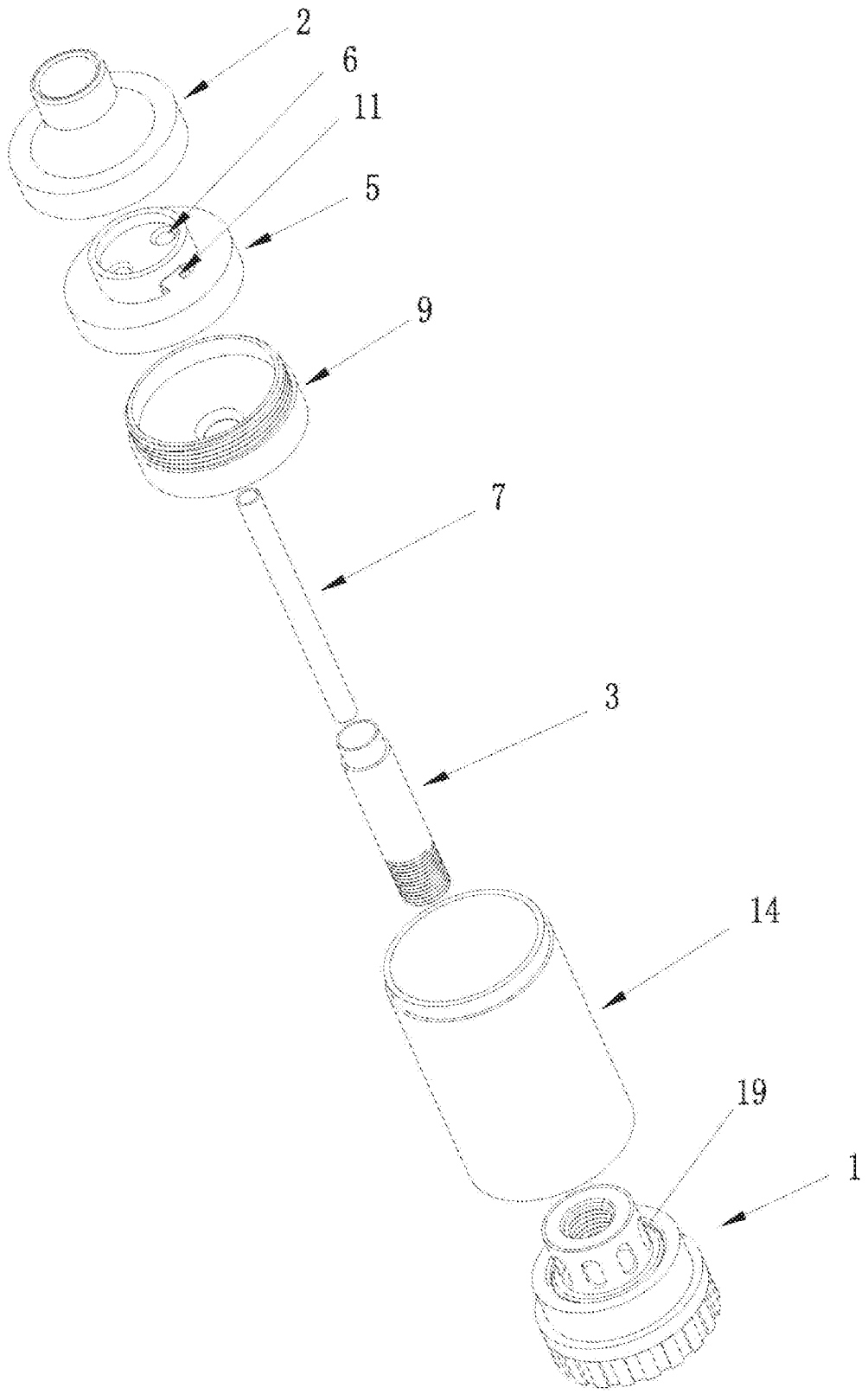
FIG. 3 is an exploded view of FIG. 1.

As shown in FIG. 1 to FIG. 3, an ultrasonic liquid electronic cigarette atomizer includes an atomization core 1, a suction nozzle 2 and an air outlet tube 3, a bottom end of the air outlet tube 3 is communicated with an atomization chamber of the atomization core 1, a top end of the air outlet tube 3 is communicated with the suction nozzle 2, the top end of the air outlet tube 3 is communicated with a bottom end of the suction nozzle 2 through a liquid blocking chamber 4, and the diameter of a top end of the liquid blocking chamber 4 is greater than the diameter of the bottom end of the suction nozzle 2. The diameter of the liquid blocking chamber 4 gradually decreases and extends from the top end to the bottom end (in a funnel shape), so that condensed liquid droplets in the liquid blocking chamber 4 can quickly return to the atomization core 1 along an inner hole of the air outlet tube 3 for reuse; and the top end of the air outlet tube 3 is communicated with the bottom of the suction nozzle 2 through the liquid blocking chamber 4, so that when a person smokes by tilting an electronic cigarette, the smoke first passes through the air outlet tube 3, the liquid blocking chamber 4 and then reaches the suction nozzle 2. Because the diameter of the top end of the liquid blocking chamber 4 is greater than the diameter of the bottom end of the suction nozzle 2, liquid droplets in the smoke accumulate in the liquid blocking chamber 4 without flowing out along an inner side wall of the suction nozzle 2, which can prevent a user from sucking the liquid droplets and achieve a good smoke taste.

The ultrasonic liquid electronic cigarette atomizer further includes a connecting seat 5 between the liquid blocking chamber 4 and the suction nozzle 2, an air tube 6 is disposed in the connecting seat 5, the bottom of the air tube 6 extends into the liquid blocking chamber 4, the side wall of the air tube 6 is not in contact with the side wall of the liquid blocking chamber 4, and the liquid blocking chamber 4 is communicated with the suction nozzle 2 through the air tube 6. The length of the air tube 6 extending into the liquid blocking chamber 4 is 1/15 to 1/2 of the diameter of the top end of the liquid blocking chamber 4, and does not abut against the bottom of the liquid blocking chamber 4, thereby avoiding sucking liquid caused by the fact that the condensed liquid droplets in the liquid blocking chamber 4 enter the air tube 6.

The liquid blocking chamber 4 is communicated with the suction nozzle 2 through the air tube 6, and the air tube 6 extends into the liquid blocking chamber 4 and is not in contact with the inner wall of the liquid blocking chamber 4, thereby further blocking the liquid droplets in the liquid blocking chamber 4 from entering the user's mouth through the suction nozzle 2, and improving the smoke taste and user experience.

The ultrasonic liquid electronic cigarette atomizer further includes an air inlet tube 7, one end of the air inlet tube 7 is communicated with the atomization chamber of the atomization core 1, and the other end of the air inlet tube 7 is communicated with the outside through an annular air inlet channel 8 formed along the circumference of the side wall of the atomizer. Since the air inlet channel 8 is formed along the circumference of the side wall of the atomizer, while the air inlet channel in the prior art is a single hole or slot, if the air inlet channel is blocked by something, no air flow passes through the inside of the electronic cigarette, and no smoke can be sucked. Therefore, the annular air inlet channel 8 can prevent the hand or mouth from blocking the single air inlet channel to affect the smoking effect.

A liquid chamber cover 9 is disposed between the connecting seat 5 and the air outlet tube 3, and the liquid blocking chamber 4 is disposed at the top of the liquid chamber cover 9.

The annular air inlet channel 8 around the side wall of the atomizer is formed between the bottom of the suction nozzle 2 and the connecting seat 5, and the air inlet channel 8 is communicated with the atomization chamber of the atomization core 1 through the air inlet tube 7.

The connecting seat 5 is detachably connected to the liquid chamber cover 9. The connecting seat 5 is detachably connected to the liquid chamber cover 9, and when the atomizer is used multiple times or used for a long time, the connecting seat 5 can be detached, and then the liquid blocking chamber 4 is cleaned, so that the atomizer is more hygienic and liquid droplets can be further prevented from being sucked.

The atomization core 1 is detachably connected to the bottom of the air outlet tube 3. When the atomization core 1 needs to be detached, the end of the atomization core 1 that is not inserted into a liquid chamber 12 is held by hand, and then the atomization core 1 can be detached by rotating or pressing or direct pulling, so that the atomization core 1 is more convenient to replace, and the use and maintenance costs are reduced. An air chamber 10 is formed at the bottom of the suction nozzle 2, the air chamber 10 is a space enclosed after the bottom of the suction nozzle 2 is connected to the connecting seat 5, and the connecting seat 5 is provided with an air inlet 11 communicated with the air chamber 10. Therefore, the air chamber 10 can be used to prevent foreign impurities entering the air inlet 11. The air inlet channel 8, the air chamber 10, the air inlet 11, the air inlet tube 7, and the atomization chamber of the atomization core 1 are communicated in sequence. During smoking, air enters the air chamber 10 from the annular air inlet channel 8, then enters the air inlet tube 7 through the air inlet 11 in the connecting seat 5, passes through the atomization chamber of the atomization core 1, and enters the mouth from the air outlet tube 3, the liquid blocking chamber 4, the air tube 6, and the suction nozzle 2 in sequence. Arrows in FIG. 1 and FIG. 2 indicate the direction of air flow.

The ultrasonic liquid electronic cigarette atomizer further includes a liquid chamber 12, the atomization core 1 includes an ultrasonic atomization sheet 13 and a liquid guiding structure, and the ultrasonic atomization sheet 13 is communicated with the liquid chamber 12 through the liquid guiding structure. The liquid chamber cover 9 is disposed at the top of a liquid storage sleeve 14, and the liquid chamber 12, the air inlet tube 7, and the air outlet tube 3 are all disposed in the liquid storage sleeve 14. The ultrasonic atomization sheet 13 is a solid piezoelectric ceramic ultrasonic atomization sheet or the like.

The atomization core 1 further includes a base 24 at the bottom of the liquid storage sleeve 14, and the atomization core 1 extends from the base 24 into the liquid storage sleeve 14 and is detachably connected to the bottom of the air outlet tube 3. The atomization core 1 further includes an inner sleeve 15 and an outer sleeve 16 sleeved on the inner sleeve 15, and the liquid guiding structure includes an atomization cotton 17 and a liquid storage cotton 18. A liquid inlet hole 19 is formed in the side wall of the outer sleeve 16, the liquid storage cotton 18 is disposed between the inner sleeve 15 and the outer sleeve 16, the liquid storage cotton 18 is communicated with the liquid chamber 12 through the liquid inlet hole 19, and the liquid storage cotton 18 is communicated with an atomization surface of the ultrasonic atomization sheet 13 through the atomization cotton 17. The liquid in the liquid chamber 12 is guided to the ultrasonic atomization sheet 13 through the liquid inlet hole 19, the liquid storage cotton 18, and the atomization cotton 17 in sequence.

An atomization seat 20 is disposed in the outer sleeve 16, and the ultrasonic atomization sheet 13 is erected and fixed by the atomization seat 20. The atomization seat 20 is made of silica gel or the like. An electrode 21 electrically connected to the ultrasonic atomization sheet 13 is also disposed at the bottom of the atomization seat 20. The atomization core 1 further includes a cotton compression spring 22, one end of the cotton compression spring 22 abuts against the inner sleeve 15, and the other end of the cotton compression spring 22 presses the atomization cotton 17 onto the ultrasonic atomization sheet 13, so that a liquid passage is reliably conducted. A gasket 23 is disposed between the outer sleeve 16 and the base 24 to prevent liquid leakage from the liquid chamber 12.

The ultrasonic liquid electronic cigarette atomizer in the present invention indicates that the ultrasonic electronic cigarette atomizer atomizes liquid in the liquid chamber to generate smoke for a user to suck.

The ultrasonic liquid electronic cigarette of the present invention includes the atomizer. The embodiments of the present invention are described above with reference to the drawings, but the present invention is not limited to the specific embodiments. The specific embodiments described above are merely illustrative but not restrictive. Many forms may also be made by those of ordinary skill in the art under the enlightenment of the present invention without departing from the purpose of the present invention and the scope of the claims, and these forms fall into the scope of the present invention.

The invention claimed is:

1. An ultrasonic liquid electronic cigarette atomizer, comprising an atomization core (1), a suction nozzle (2), and an air outlet tube (3), a bottom end of the air outlet tube (3) being communicated with an atomization chamber of the atomization core (1), a top end of the air outlet tube (3) being communicated with the suction nozzle (2), wherein:

the top end of the air outlet tube (3) is communicated with a bottom end of the suction nozzle (2) through a liquid blocking chamber (4), and a diameter of a top end of the liquid blocking chamber (4) is greater than a diameter of the bottom end of the suction nozzle (2), wherein the ultrasonic liquid electronic cigarette atomizer further comprises a connecting seat (5) between the liquid blocking chamber (4) and the suction nozzle (2), wherein:

an air tube (6) is disposed in the connecting seat (5), a bottom of the air tube (6) extends into the liquid blocking chamber (4), a side wall of the air tube (6) is not in contact with a side wall of the liquid blocking chamber (4), and the liquid blocking chamber (4) is communicated with the suction nozzle (2) through the air tube (6).

2. The ultrasonic liquid electronic cigarette atomizer according to claim 1, wherein the ultrasonic liquid electronic cigarette atomizer further comprises an air inlet tube (7), wherein:

one end of the air inlet tube (7) is communicated with the atomization chamber of the atomization core (1), and an other end of the air inlet tube (7) is communicated with an outside through an annular air inlet channel (8) formed along a circumference of a side wall of the atomizer.

3. The ultrasonic liquid electronic cigarette atomizer according to claim 1, wherein the ultrasonic liquid electronic cigarette atomizer further comprises an air inlet tube (7), wherein:

one end of the air inlet tube (7) is communicated with the atomization chamber of the atomization core (1), and an other end of the air inlet tube (7) is communicated with an outside through an annular air inlet channel (8) formed along a circumference of a side wall of the atomizer.

4. The ultrasonic liquid electronic cigarette atomizer according to claim 1, wherein:

a liquid chamber cover (9) is disposed between the connecting seat (5) and the air outlet tube (3), and the liquid blocking chamber (4) is disposed at a top of the liquid chamber cover (9).

5. The ultrasonic liquid electronic cigarette atomizer according to claim 4, wherein the connecting seat (5) is detachably connected to the liquid chamber cover (9).

6. The ultrasonic liquid electronic cigarette atomizer according to claim 1, wherein:

an annular air inlet channel (8) around the side wall of the atomizer is formed between the bottom of the suction nozzle (2) and the connecting seat (5), and the air inlet channel (8) is communicated with the atomization chamber of the atomization core (1) through the air inlet tube (7).

7. The ultrasonic liquid electronic cigarette atomizer according to claim 6, wherein:

an air chamber (10) is formed at the bottom of the suction nozzle (2), the connecting seat (5) is provided with an air inlet (11), and the air inlet channel (8), the air chamber (10), the air inlet (11), the air inlet tube (7), and the atomization chamber of the atomization core (1) are communicated in sequence.

8. The ultrasonic liquid electronic cigarette atomizer according to claim 1, wherein the atomization core (1) is detachably connected to the bottom of the air outlet tube (3).

9. The ultrasonic liquid electronic cigarette atomizer according to claim 1, wherein the atomization core (1) is detachably connected to the bottom of the air outlet tube (3).

10. The ultrasonic liquid electronic cigarette atomizer according to claim 1, wherein:

the ultrasonic liquid electronic cigarette atomizer further comprises a liquid chamber (12), the atomization core (1) comprises an ultrasonic atomization sheet (13) and a liquid guiding structure, and the ultrasonic atomization sheet (13) is communicated with the liquid chamber (12) through the liquid guiding structure.

11. The ultrasonic liquid electronic cigarette atomizer according to claim 1, wherein:

the ultrasonic liquid electronic cigarette atomizer further comprises a liquid chamber (12), the atomization core (1) comprises an ultrasonic atomization sheet (13) and a liquid guiding structure, and the ultrasonic atomization sheet (13) is communicated with the liquid chamber (12) through the liquid guiding structure.

12. An ultrasonic liquid electronic cigarette, comprising an ultrasonic liquid electronic cigarette atomizer, wherein the ultrasonic liquid electronic cigarette atomizer comprises an atomization core (1), a suction nozzle (2), and an air outlet tube (3), a bottom end of the air outlet tube (3) being communicated with an atomization chamber of the atomization core (1), a top end of the air outlet tube (3) being communicated with the suction nozzle (2), wherein:

the top end of the air outlet tube (3) is communicated with a bottom end of the suction nozzle (2) through a liquid blocking chamber (4), and a diameter of a top end of the liquid blocking chamber (4) is greater than a diameter of the bottom end of the suction nozzle (2).

wherein the ultrasonic liquid electronic cigarette atomizer further comprises a connecting seat (5) between the liquid blocking chamber (4) and the suction nozzle (2), wherein:

an air tube (6) is disposed in the connecting seat (5), the bottom of the air tube (6) extends into the liquid blocking chamber (4), a side wall of the air tube (6) is not in contact with a side wall of the liquid blocking chamber (4), and the liquid blocking chamber (4) is communicated with the suction nozzle (2) through the air tube (6).

13. The ultrasonic liquid electronic cigarette according to claim 12, wherein the ultrasonic liquid electronic cigarette atomizer further comprises an air inlet tube (7), wherein:

one end of the air inlet tube (7) is communicated with the atomization chamber of the atomization core (1), and an other end of the air inlet tube (7) is communicated with an outside through an annular air inlet channel (8) formed along a circumference of a side wall of the atomizer.

14. The ultrasonic liquid electronic cigarette according to claim 12, wherein:

a liquid chamber cover (9) is disposed between the connecting seat (5) and the air outlet tube (3), and the liquid blocking chamber (4) is disposed at a top of the liquid chamber cover (9).

15. The ultrasonic liquid electronic cigarette according to claim 12, wherein:

an annular air inlet channel (8) around the side wall of the atomizer is formed between the bottom of the suction nozzle (2) and the connecting seat (5), and the air inlet channel (8) is communicated with the atomization chamber of the atomization core (1) through the air inlet tube (7).

16. The ultrasonic liquid electronic cigarette according to claim 15, wherein:

an air chamber (10) is formed at the bottom of the suction nozzle (2), the connecting seat (5) is provided with an air inlet (11), and the air inlet channel (8), the air chamber (10), the air inlet (11), the air inlet tube (7), and the atomization chamber of the atomization core (1) are communicated in sequence.

17. The ultrasonic liquid electronic cigarette according to claim 12, wherein the atomization core (1) is detachably connected to the bottom of the air outlet tube (3).

18. The ultrasonic liquid electronic cigarette according to claim 12, wherein:

the ultrasonic liquid electronic cigarette atomizer further comprises a liquid chamber (12), the atomization core (1) comprises an ultrasonic atomization sheet (13) and a liquid guiding structure, and the ultrasonic atomization sheet (13) is communicated with the liquid chamber (12) through the liquid guiding structure.

* * * * *